US005428427A

United States Patent [19]

Lee

[11] Patent Number: 5,428,427

[45] Date of Patent: Jun. 27, 1995

[54] DEVICE FOR DETECTING TONER USED IN AN ELECTROPHOTOGRAPHY MACHINE

[75] Inventor: Dong-Ho Lee, Seongnam, Rep. of Korea

[73] Assignee: SamSung Electronics Co., Ltd., Suwon, Rep. of Korea

[21] Appl. No.: 989,828

[22] Filed: Dec. 14, 1992

[51] Int. Cl.[6] ..... G03G 21/00

[52] U.S. Cl. ..... 355/246; 118/688; 355/203

[58] Field of Search ..... 355/208, 246, 260, 245, 355/203–209; 118/689, 688, 690; 222/DIG. 1; 356/445, 448

[56] References Cited

U.S. PATENT DOCUMENTS

| | | | |
|---|---|---|---|
| 4,592,642 | 6/1986 | Imaizumi et al. | 355/260 |
| 4,739,365 | 4/1988 | Hino . | |
| 4,951,091 | 8/1990 | Nawata . | |
| 4,989,754 | 2/1991 | Grasso et al. | 222/39 |
| 5,012,221 | 4/1991 | Nishimura et al. | 354/456 |
| 5,035,198 | 7/1991 | Niito . | |
| 5,036,363 | 7/1991 | Iida et al. . | |
| 5,095,331 | 3/1992 | Takano . | |
| 5,105,219 | 4/1992 | Yoshikado . | |
| 5,160,966 | 11/1992 | Shiina et al. . | |
| 5,162,848 | 11/1992 | Saitoh et al. . | |
| 5,196,886 | 3/1993 | Nakane et al. | 355/246 |
| 5,216,462 | 6/1993 | Nakajima et al. | 355/203 |

FOREIGN PATENT DOCUMENTS

| | | |
|---|---|---|
| 54-1581 | 1/1979 | Japan . |
| 60-49368 | 3/1985 | Japan . |
| 63-95481 | 4/1988 | Japan . |

*Primary Examiner*—A. T. Grimley
*Assistant Examiner*—Thu Dang
*Attorney, Agent, or Firm*—Robert E. Bushnell

[57] ABSTRACT

A device for informing whether fresh toner should be newly supplied into a developer (20) into an electrophotography machine comprises a sleeve (22) for delivering toner (29) to a photosensitive drum, a blade (23) for regulating the distribution of the toner deposited on the sleeve (22), an agitator (24) for agitating the toner, a hopper (21) for loading the toner, a lever (25) with an upper projection (26) and lower support (27) pivotally moved with a pivot pin (25') attached on an inside wall (21') of the hopper (21) towards the sleeve (22), a metal plate (28) supported by the lower support (27), an actuator (32) with a magnet (36) and light shield (34) pivotally moved with another pivot pin (35), and a photosensor (31). Wherein, if the hopper (21) is devoid of the toner by consuming, the magnet (36) is attracted towards the metal plate (28) so as to cause the light shield (34) to block the photosensor (31).

6 Claims, 2 Drawing Sheets

DEVICE FOR DETECTING TONER USED IN AN ELECTROPHOTOGRAPHY MACHINE

TECHNICAL BACKGROUND

The present invention relates to a developer which develops an electrostatic latent image on a photosensitive drum in an electrophotography machine, and more particularly to a device for informing whether fresh toner should be newly supplied into the developer.

Referring to FIG. 1, a conventional developer 1 includes a sleeve 4 for delivering toner 7 to a photosensitive drum 3, a blade 5 for regulating the distribution of the toner 7 deposited on the sleeve 4, an agitator 6 for agitating the toner 7, a hopper 2 for loading the toner, and a toner sensor 8 mounted on an inside wall of the hopper below the agitator 6. The toner sensor 8 consists of a piezoelectric element that is subjected to the pressure of the toner 7 in the hopper so as to generate a voltage informing whether the toner is existent or not in the hopper by consuming. Namely the weight of the toner in the hopper actuates the piezoelectric element to generate the voltage. The voltage from the piezoelectric element is applied to a central processing unit (CPU) so as to turn on an indicating lamp for user for indicating the existence of sufficient amount of the toner in the hopper 2. On the other hands, if there is no toner in the hopper, the piezoelectric element does not generate the voltage so that the indicating lamp is turned off.

Another conventional device for informing whether ferritic toner is existent or not in the hopper includes, as shown in FIG. 2, a photosensor 8 pivotally moved with a pivot pin, and an actuator 10 with a magnet 9 at one side thereof and with a light shield 12 for shielding a light at another side thereof. When the ferritic toner 7 is loaded into the hopper 2, the ferritic toner attracts the magnet 9 so as to cause the light shield 12 to prevent the photosensor from receiving the light. Hence an indicating lamp is turned on for user for indicating the existence of sufficient amount of the ferritic toner in the hopper. Conversely, if there is no ferritic toner 7 the hopper 2, the magnet 9 is separated from the bottom of the hopper 2 so as to cause the light shield 12 to move away from the photosensor. Accordingly, the indicating lamp is turned off.

In these two conventional devices, the former has the drawbacks that the piezoelectric element is very expensive compared to the photosensor. Further, it is very difficult to install the piezoelectric element within the hopper, and the output voltage of the piezoelectric element varies with the loaded amount of the toner, thus resulting in technical complexity. Meanwhile the latter must use only the ferritic toner.

SUMMARY OF THE INVENTION

It is an object of the present invention to provide a reliable device for informing whether fresh toner should be newly supplied into a developer in an electrophotography machine.

It is another object of the present invention to reduce the production cost.

According to the present invention, a device for informing whether fresh toner should be newly supplied into a developer (20) in an electrophotography machine comprises a sleeve (22) for delivering toner (29) to a photosensitive drum, a blade (23) for regulating the distribution of the toner deposited on the sleeve (22), an agitator (24) for agitating the toner, a hopper (21) for loading the toner, a lever (25) with an upper projection (26) and lower support (27) pivotally moved with a pivot pin (25') attached on an inside wall (21') of the hopper (21) towards the sleeve (22), a metal plate (28) supported by the lower support (27), an actuator (32) with a magnet (36) and light shield (34) pivotally moved with another pivot pin (35), and a photosensor (31). wherein, if said hopper (21) is devoid of said toner by consuming, said magnet (36) is attracted towards said metal plate (28) so as to cause said light shield (34) to block said photosensor (31).

The present invention will now be described more specifically with reference to the drawings attached only by way of example.

BRIEF DESCRIPTION OF THE ATTACHED DRAWINGS

DETAILED DESCRIPTION OF A CERTAIN PREFERRED EMBODIMENT

Figure 1:
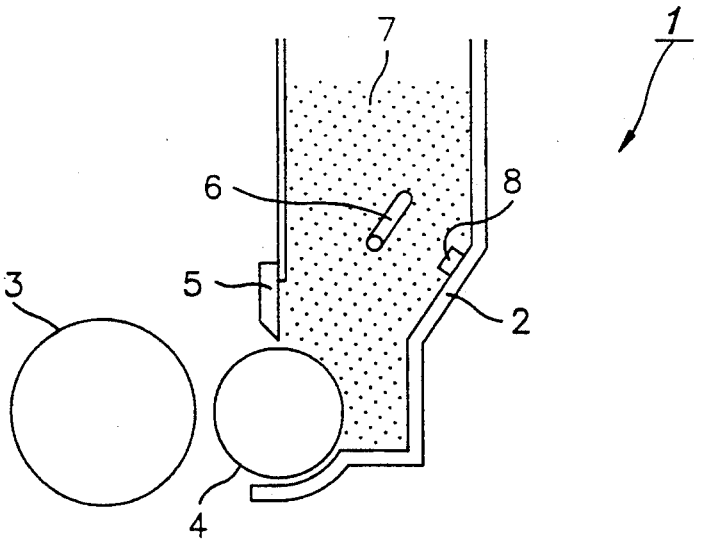
(PRIOR ART) FIG. 1
FIG. 1 is a schematic diagram of a conventional developer with a device for detecting the toner.
Figure 2:
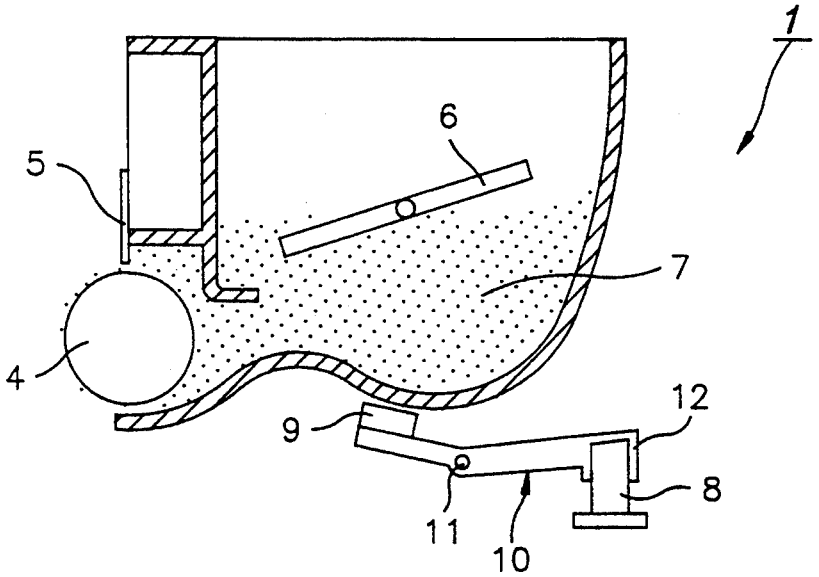
(PRIOR ART) FIG. 2
FIG. 2 is a schematic diagram of another conventional developer with a device for detecting the toner.

A developer 20 in an electrophotography machine includes a sleeve 22 for delivering toner 29 to a photosensitive drum, a blade 23 for regulating the distribution of the toner deposited on the sleeve 22, an agitator 24 for agitating the toner, and a hopper 21 for loading the toner. Installed below the hopper 21 is a detecting device 30 for informing whether the fresh toner should be newly supplied into the hopper 21. A lever 25 is pivotally moved with a pivot pin 25' attached on an inside wall 21' of the hopper 21 towards the sleeve 22. Further, the lever 25 has an upper projection 26 and lower support 27. A metal plate 28 is attached to the lower support 27 by a suitable means such as a threaded bolt. The upper projection 26 of the lever 25 is so made as to be touched by the ends of the agitator 24 rotated.

An actuator 32 moved with another pivot pin 35 has a magnet 36 at one side thereof and light shield 34 at another side thereof. The magnet 36 is so positioned as to be attracted by the metal plate 28. The light shield 34 is so made as to block a photosensor 31 when the magnet 36 is attracted by the metal plate 28.

Figure 3:
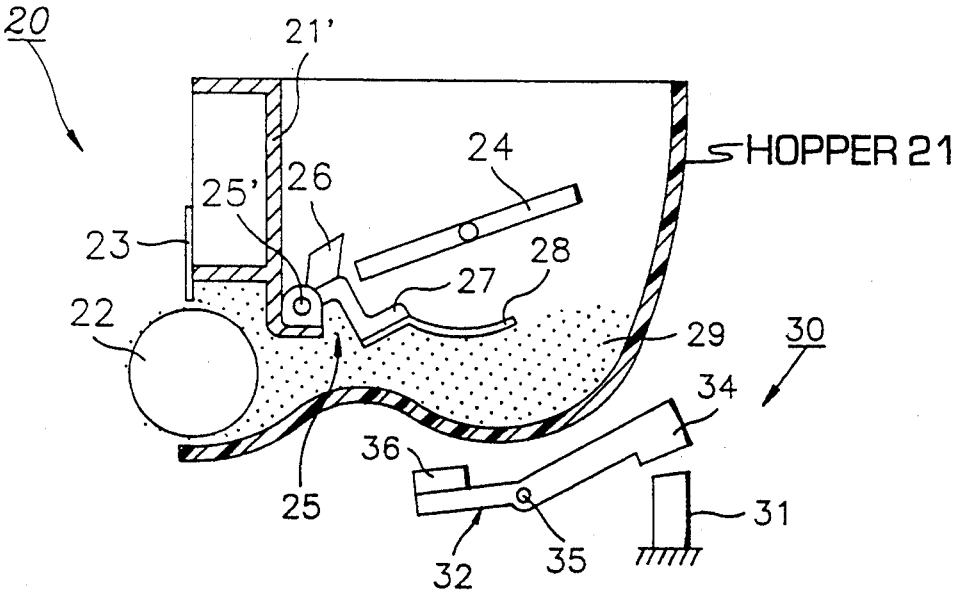
FIG. 3 is a developer with a device for detecting toner according to the present invention, wherein sufficient amount of the toner is loaded in the hopper.
Figure 4:
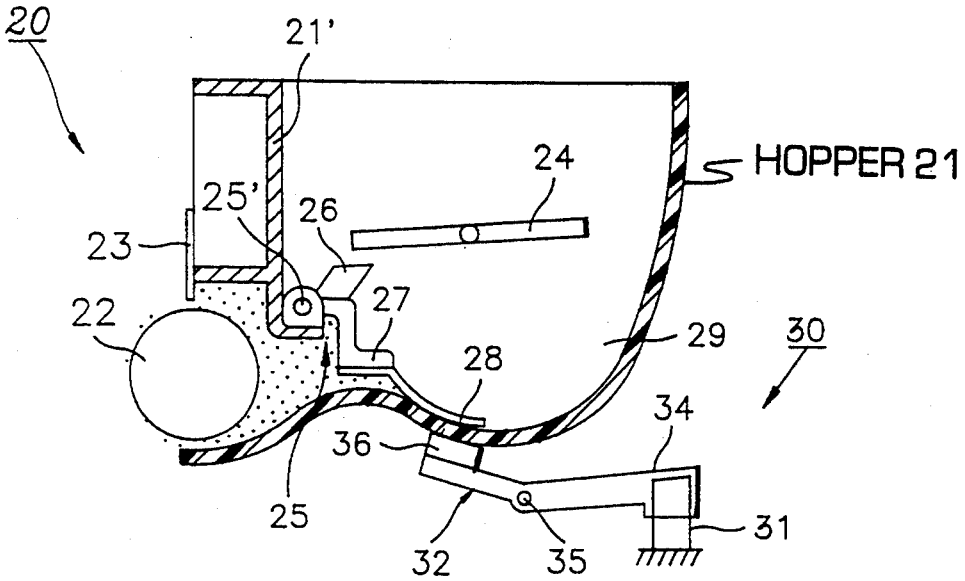
FIG. 4 is a similar view according to FIG. 3, wherein there is no toner in the hopper.

When sufficient amount of the toner 29 is loaded in the hopper 21 and the agitator 24 is rotated to agitate the toner, the upper projection 26 is pushed upwards by the ends of the lever 24 and then the metal plate 28 is placed the top of the toner, as shown in FIG. 3. Thus the metal plate 28 is separated far away from the magnet 36 with the toner 29 therebetween, so that the magnet is detached from the bottom of the hopper so as to cause the light shield 34 to be removed away from the photosensor 31, thereby turning on an indicating lamp for indicating that the hopper 21 is loaded with sufficient amount of the toner 29.

If the toner 29 is completely consumed by repeated copying operations, the metal plate 28 of the lever 25 pivots downwards on the pivot pin 25' so as to contact the inside of the bottom wall of the hopper 21. Then the magnet 36 is attracted by the metal plate 28, pivoting the actuator 32 clockwise on the pivot pin 35, so that the light shield 34 blocks the photosensor 31. This generates a digital signal applied to CPU so as to turn off the indicating lamp for indicating that there is no toner in the hopper. The photosensor may be replaced by a micro-switch.

What is claimed is:

1. A device for indicating when toner should be newly supplied into a developer in an electrophotography machine having an indicator lamp for indicating the presence of toner, the device comprising:

a sleeve for delivering the toner to a photosensitive drum;

a blade for regulating the toner deposited on said sleeve;

an agitator for agitating the toner;

a hopper for loading the toner;

a lever with an upper projection and lower support pivotally moved with a pivot pin attached on an inside wall of said hopper towards said sleeve;

a metal plate supported by said lower support;

an actuator with a magnet and light shield pivotally moved with another pivot pin; and a photosensor, wherein, when said hopper is depleted of the toner said magnet is attracted towards said metal plate so as to cause said light shield to block said photosensor.

2. A device for changing an indication state of an indicator lamp when a hopper in an electrophotography machine is depleted of toner, the indicator lamp having a first indication state when the hopper contains toner and a second indication state when the hopper is depleted of the toner, the device comprising:

a lever pivotally mounted to an inside wall of a hopper, said lever having a metal plate attached thereto;

a pivot mounted outside of the hopper;

an actuator pivotally mounted to said pivot;

a magnet attached to one end of said actuator;

a light shield attached to an opposite end of said actuator, said one end being positioned to one side of said pivot and said opposite end being positioned to an opposite side of said pivot; and a photosensor;

said metal plate for contacting an inside bottom portion of the hopper when the hopper is depleted of the toner, said magnet being attracted towards said metal plate when said metal plate is in contact with said inside bottom portion of the hopper, said actuator being rotated about said pivot when said magnet is attracted towards said metal plate; and said light shield for blocking said photosensor when said actuator is rotated due to said magnet being attracted towards said metal plate to cause the indicator lamp to change from the first indication state to the second indication state.

3. A device for changing an indication state of an indicator lamp when a hopper in an electrophotography machine is depleted of toner, the indicator lamp having a first indication state when the hopper contains toner and a second indication state when the hopper is depleted of the toner, the device comprising:

a lever pivotally mounted to an inside wall of a hopper, said lever having a metal plate attached thereto, said metal plate for contacting an inner bottom portion of the hopper when the hopper is depleted of the toner;

a pivot mounted outside of the hopper; and sensing means being rotated about said pivot when said metal plate contacts said inside bottom portion of the hopper for causing the indicator lamp to change from the first indication state to the second indication state.

4. The device as set forth in claim 3, wherein said sensing means comprises a microswitch.

5. The device as set forth in claim 3 wherein said sensing means comprises:

an actuator pivotally mounted to said pivot;

a magnet attached to one end of said actuator;

a light shield attached to an opposite end of said actuator, said one end being positioned to one side of said pivot and said opposite end being positioned to an opposite side of said pivot; and a photosensor.

6. The device as set forth in claim 5, wherein said magnet is attracted towards said metal plate when said metal plate is in contact with said inside bottom portion of said hopper, said actuator is rotated about said pivot when said magnet is attracted towards said metal plate; and said light shield blocks said photosensor when said actuator is rotated due to said magnet being attracted towards said metal plate for causing said indicator lamp to change from said first indication state to said second indication state.

* * * * *